United States Patent [19]

Dunlop et al.

[11] 3,954,062

[45] May 4, 1976

[54] CASELESS PROPELLANT CHARGES

[75] Inventors: James Littlejohn Dunlop, Kilmarnock; Robert Reid Stevely, Saltcoats, both of Scotland

[73] Assignee: Imperial Chemical Industries Limited, London, England

[22] Filed: Sept. 20, 1974

[21] Appl. No.: 507,962

Related U.S. Application Data

[63] Continuation of Ser. No. 354,911, April 26, 1973, abandoned.

[30] Foreign Application Priority Data

May 12, 1972 United Kingdom ..... 22340/72

[52] U.S. Cl. ..... 102/99; 86/1 R; 102/DIG. 1; 264/3 R

[51] Int. Cl.[2] ..... F42B 1/00; C06B 21/00

[58] Field of Search ..... 86/1; 102/99, DIG. 1; 264/3, 3 C, 3 D, 3 E

[56] References Cited

UNITED STATES PATENTS

| | | | |
|---|---|---|---|
| 2,342,204 | 2/1944 | Mackey | 264/3 B |
| 3,203,172 | 8/1965 | Sutherland | 149/22 X |
| 3,311,057 | 3/1967 | Quinlan et al. | 102/DIG. 1 |
| 3,345,945 | 10/1967 | Quinlan et al. | 102/DIG. 1 |
| 3,381,065 | 4/1968 | Deschner | 264/3 R |
| 3,563,177 | 2/1971 | Ritchey | 102/38 |
| 3,576,926 | 4/1971 | O'Mara | 264/3 R |
| 3,673,286 | 6/1972 | Remaly | 264/3 |
| 3,688,697 | 9/1972 | Paul et al. | 102/DIG. 1 |

*Primary Examiner*—Samuel W. Engle
*Assistant Examiner*—Harold Tudor
*Attorney, Agent, or Firm*—Cushman, Darby & Cushman

[57] ABSTRACT

Porous propellant composition for caseless charges is improved by compressing the composition to an average pressure of at least 1,000 psi. The invention also includes the improved propellant charges.

9 Claims, No Drawings

CASELESS PROPELLANT CHARGES

This is a continuation, of application Ser. No. 354,911 filed Apr. 26, 1973, now abandoned.

This invention relates to a method of making propellant charges suitable for use as caseless propellant explosive charges and to the charges produced thereby.

The use of caseless propellant charges as the power source for projectiles and for explosive percussion tools such as nail guns is now established. However, the design of a satisfactory unitary propellant charge having ballistic properties comparable to those of a granular charge presents many problems and as yet caseless charges have not captured any significant proportion of the market.

A caseless charge must be designed so that, on ignition, burning will not be limited to the surface of the charge but will occur throughout the mass as in a loose charge. In order to achieve this two distinct methods of production have been proposed, one involving compaction of individual grains and the other involving the use of porous charges. In the former method the grains are compacted dry or treated with plasticiser or solvent to stick the grains together in a coherent mass, the degree of compaction aimed at being such as to bind the grains sufficiently for normal handling but to leave the charge sufficiently friable that the grains separate and burn as a loose charge when subjected to the shockwave produced when the primer is actuated. It is extremely difficult to achieve a balance of the many factors involved so as to produce a satisfactory commercial charge which will burn reliably without leaving a residue which can jam the breech mechanism of a nail gun. In the latter method unitary charges are shaped by moulding or extrusion from a mass of softened propellant composition containing a removable filling material and the filler is subsequently removed, for example, by leaching out with water to produce voids in the charge. Although by this method greater control can be exercised over the uniformity and consequently over the ballistic properties of the charge, nevertheless it is very difficult to achieve ballistic properties comparable to those of a granular powder. The charge generally fails to break sufficiently when the primer is ignited and consequently the burning rate is usually too slow, the combustion is often incomplete and harmful residues are produced.

The object of this invention is to produce unitary porous propellant charges suitable for use as caseless charges which will burn quicker and more cleanly than charges of this kind hitherto available.

We have now discovered that porous propellant composition for caseless charges can be improved by compressing the porous composition to an average pressure of at least 1,000 psi. This compression makes the charge more brittle and friable so that it disintegrates to a greater extent when subjected to the shock from a priming charge. In consequence, the charge burns quicker, cleaner and more uniformly. This effect cannot be obtained by a reduction in the amount of filler used (and consequently the porosity) in the original uncompressed porous composition to achieve higher density. Further, the reliability of ignition of the priming charge from the striking pin of a gun is enhanced because of the reduced resiliency of the charge.

Thus, in accordance with this invention, porous propellant composition suitable for unitary caseless propellant charges is prepared by a method wherein porous propellant composition is compressed to an average pressure of at least 1,000 psi. Preferably the compression should be within the range 1,000 to 40,000 psi and more preferably within the range 2,000 to 20,0000 psi. The reduction in volume of the composition should preferably be at least 20% and more preferably at least 40% of the original volume.

Although the porous composition may readily be compressed in bulk or sheet form, in a convenient procedure the porous propellant composition is divided into quantities appropriate for individual charges which are then compressed and shaped to their final desired shape in one operation by compressing in a mould.

In use, the propellant charge requires a small charge or priming composition and it is advantageous to form an indent for the primer charge in the propellant charge in the compressing and shaping operation.

The charges may conveniently be prepared by extruding an extrudable mixture of propellant composition, solvent for the propellant composition and removable filler through a die, drying off the solvent, cutting the extruded composition into lengths suitable for a single charge, leaching out the filler to produce voids in the composition and compressing the charges individually in a mould at a pressure of at least 1,000 psi to shape the charge to the desired form. The composition may, if desired, be extruded through a multi-pin die to produce longitudinal passages which increase the burning speed of some compositions.

The filler preferably comprises a water-soluble salt, for example potassium nitrate, which may be removed by washing the charge with water. The porosity may thus be varied widely. The amount of filler may, for example, conveniently range form 1 to 4 parts for each part by weight of total propellant composition.

Preferred solvents for making the extrudable mixture include diethyl ether, ethyl alcohol and acetone which produce a fast burning colloided nitrocellulose.

The propellant composition may comprise any of the well known single-base propellants consisting mainly of nitrocellulose having 12.9 to 13.4% N by weight, double-base propellants which comprise nitroglycerine in addition to nitrocellulose or triple-base propellants which comprise nitroguanidine together with nitrocellulose and nitroglycerine. The compositions may additionally contain any of the stabilising and modifying ingredients commonly used in such compositions.

The invention also includes a unitary caselss propellant charge whenever prepared by the aforedescribed method of the invention and such a charge having a charge of priming composition operatively associated therewith.

Suitable priming compositions include, for example, lead azide, lead styphnate, tetrazine, cyclotrimethylenetrinitramine, pentaerythritol tetranitrate.

The invention is further illustrated by the following Examples in which all parts and percentages are by weight unless otherwise specified.

EXAMPLE 1

99 parts (as dry) of nitrocellulose, having an average nitrogen content of 13.1% N, wetted with 50 parts of ethyl alcohol, 1 part of diphenylamine, 200 parts of potassium nitrate (all passing 170 BS sieve) and 100 parts of diethyl ether were mixed to form an extrudable dough. The dough was extruded through a 10.5 mm diameter 7-pin circular die having a central pin and 6 other pins of circular cross-section and 1.3 mm diameter spaced at equal distances with their axes 2.9 mm from the die axis, to form a cord with 7 passages. The cord was dried in air and cut into individual charge lengths of 9.5 mm. The charges were steeped progressively in hot water (60°C) to remove most of the potassium nitrate and dried in hot air. The resulting charges, which had shrunk to 8.4 mm in diameter and length, were pressed in a mould at a pressure of 6,000 psi to form cylindrical charges 9.0 mm in diameter and 3.7 mm long (60% reduction in volume) with a cylindrical primer indent 4.5 mm diameter and 2.0 mm deep in an end of each charge. The average weight of the charges was 0.26 grams.

The composition of the single-base propellant charge was

Nitrocellulose 99 per cent
Diphenylamine 1 per cent
Potassium Nitrate 1 per cent A priming composition consisting of 88 parts of lead styphnate and 12 parts of ground glass was mixed with an aqueous gum arabic solution to form a thick slurry which was filled dropwise into the primer indent and allowed to dry.

The caseless propellant charge of this Example was tested in an explosively actuated nail driving gun and it burned cleanly and had ballistic properties comparable to a corresponding loose granular charge. It withstood normal rough handling without breakage.

EXAMPLE 2

99 parts (as dry) of nitrocellulose, having an average nitrogen content of 13.1%, wetted with 58 parts of ethyl alcohol, 1 part diphenylamine, 200 parts of potassium nitrate (all passing 170 BS sieve) and 92 parts of diethyl ether were mixed to form an extrudable dough. The dough was extruded through a die with a circular cross-section of 10.5 mm diameter and the subsequent cord cut into individual charge lengths of 9.5 mm. The charges were steeped progressively in hot water (60°C) until the residual potassium nitrate content was less than 1.0% and then dried in a current of hot air.

The charges now weighed approximately 0.28 grams and were 8.4 mm in length and diameter. They were pressed in a mould at a pressure of 8,000 psi as described in Example 1.

0.020 grams of a lead azide priming composition was pressed into the primer indent and the charge was tested in an explosively actuated nail driving gun where it burned cleanly and had ballistic properties comparable to a corresponding loose granular charge.

EXAMPLE 3

60 parts of nitrocellulose having an average nitrogen content of 13.1% N and 1 part of ethyl centralite were slurried with 600 parts of water and 39 parts of nitroglycerine were mixed into the slurry to form a paste. The paste was dried in hot air and mixed with 200 parts of potassium nitrate (all passing 170 BS sieve), 30 parts of acetone and 30 parts of ethyl alcohol to form a dough, which was extruded through a 7-pin die as described in Example 1. The multi-tubular cord was dried out, cut and steeped in water, dried and compressed at a pressure of 9,000 psi as in Example 1 to give charges of the same weight and dimensions as the charges of Example 1.

The composition of the double-base propellant charge thus formed was

Nitrocellulose 60 parts
Nitroglycerine 39 parts
Ethyl centralite 1 part
Potassium nitrate 1 part The primer indent was filled with a slurry of tetrazine in nitrocellulose solution and covered with a protective coating of collodion.

When tested in a nail gun the charges burned cleanly with ballistic properties comparable to those of a corresponding loose charge. They withstood rough handling.

What we claim is:

1. A method of preparing a unitary caseless propellant charge, comprising forming an integral mass of propellant composition containing particles of a removable filler, leaching out the filler particles to produce voids in the composition and to form an integral dry mass of porous propellant composition, compressing said integral porous mass to an average pressure of at least 1,000 psi to reduce the volume of the mass at least 20% thereby rendering the resulting charge more brittle and firable so that it disintegrates to a greater extent when subjected to shock from a priming charge.

2. A method as in claim 1 wherein the compression pressure is within the range of 1,000 to 40,000 psi.

3. A method as claimed in claim 1 wherein said mass is appropriate for an individual charge and said mass is compressed and shaped in a mould to form a caseless propellant charge.

4. A brittle friable unitary caseless propellant charge produced by the method of claim 1.

5. A method of preparing a unitary caseless propellant charge comprising the steps of extruding an extrudable mixture of propellant composition, solvent for the propellant composition, and removable filler through a die, drying off the solvent, cutting the extruded composition into lengths suitable for a single charge, leaching out the filler to produce voids in the composition, and compressing the now porous charge individually in a mould at a pressure of at least 1,000 psi to reduce the volume of the charge, to shape the charge and to render the charge more brittle and friable so that it disintegrates to a greater extent when subjected to shock from a priming charge.

6. A method as claimed in claim 5 wherein the propellant composition is extruded through a multi-pin die to produce longitudinal passages in the propellant charge.

7. A method as claimed in claim 5 wherein the filler comprises a water-soluble salt which is leached out by washing with water.

8. A method as claimed in claim 5 wherein the amount of filler ranges from 1 to 4 parts for each part by weight of the total propellant composition.

9. A method as claimed in claim 5 wherein the solvent is selected from the group consisting of diethyl ether, ethyl alcohol and acetone.

* * * * *